United States Patent [19]

Bergagnini

[11] Patent Number: 4,684,108

[45] Date of Patent: Aug. 4, 1987

[54] PANEL FENCE

[76] Inventor: Sergio Bergagnini, P.O. Box 83408, Oklahoma City, Okla. 73148

[21] Appl. No.: 905,460

[22] Filed: Sep. 10, 1986

[51] Int. Cl.[4] ..... E04H 17/16

[52] U.S. Cl. ..... 256/24; 256/23; 256/73

[58] Field of Search ..... 256/24, 25, 26, 22, 256/23, 73, 27

[56] References Cited

U.S. PATENT DOCUMENTS

| | | | |
|---|---|---|---|
| 975,428 | 11/1910 | Hohulin | 256/22 |
| 1,703,372 | 2/1929 | Tilton | 256/25 |
| 2,460,028 | 1/1949 | Obert | 256/22 X |

*Primary Examiner*—Andrew V. Kundrat

*Attorney, Agent, or Firm*—Dunlap, Codding & Peterson

[57] ABSTRACT

A modular fence construction utilizing flat bar stock for the rails and pickets, and substantially standard metal shapes for the posts between fence sections.

7 Claims, 8 Drawing Figures

PANEL FENCE

BRIEF SUMMARY OF THE INVENTION

1. Field of the Invention.

This invention relates to improvements in fences, and particularly modular fences.

2. Background of the Invention.

A great variety of designs of fences have been proposed, including many designs of metal fences for decorative as well as utilitarian purposes. However, in the past, so far as is known, such metal fences involve the use of expensive, complicated connectors for securing the pickets to the rails and/or the rails to posts, resulting in an expensive fence difficult to assemble. Another class of metal fence designs proposed involve the use of special metal shapes, usually involving metal extrusions, again resulting in a complicated and expensive fence construction.

The fence of the present invention provides a construction of the fence in panels utilizing standard metal shapes to provide an economical construction. The posts employed with the fence are of substantially standard shapes, such that the fence panels can be secured to posts by a homeowner in a simple, convenient manner. The result is not only an attractive, but also highly utilitarian fence.

DETAILED DESCRIPTION OF THE DRAWINGS

Figures 1, 1A:
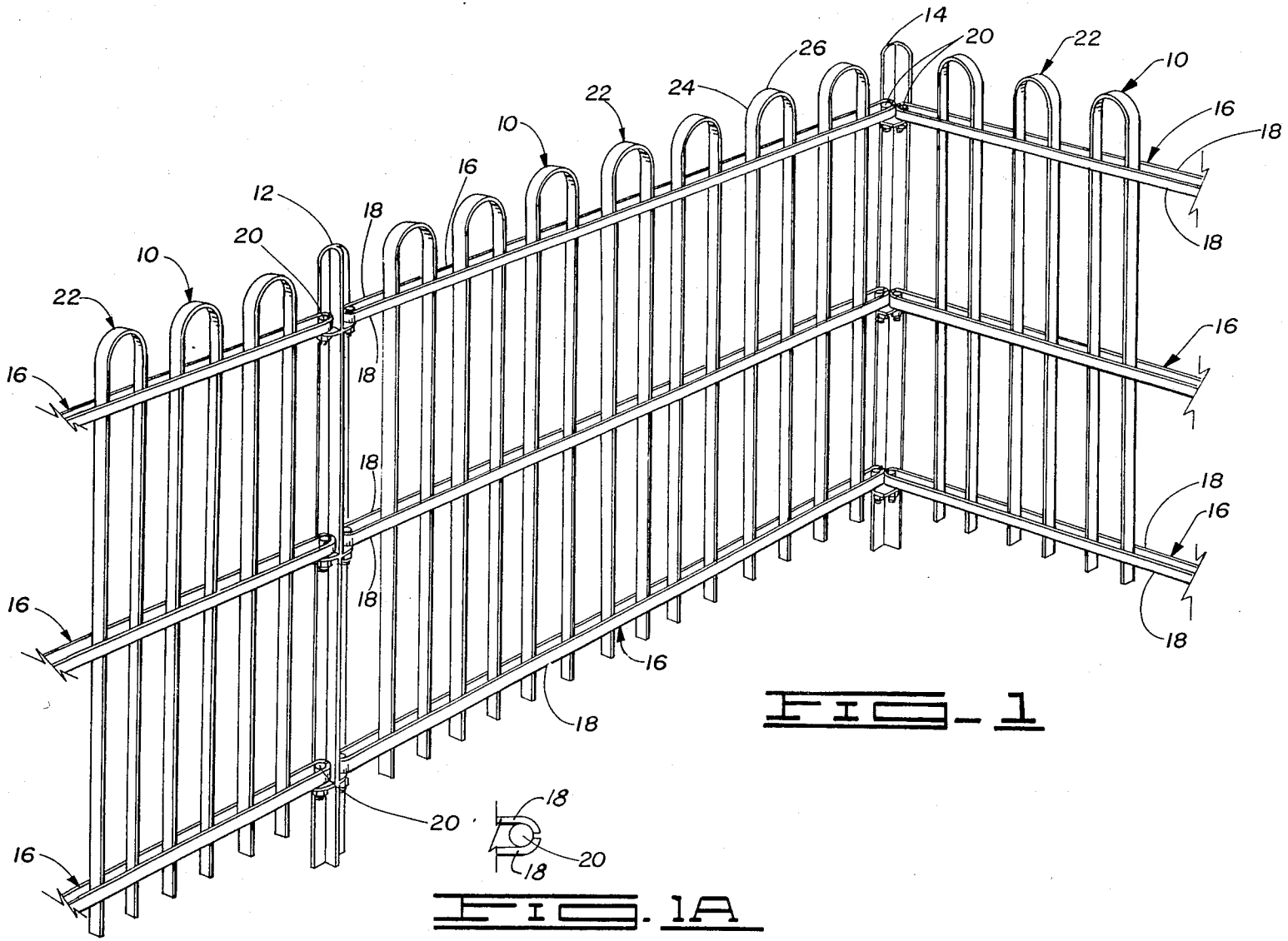
FIG. 1 is a perspective view of portions of a fence constructed in accordance with this invention.
FIG. 1A is an enlarged plan view of the end of a typical rail.

Referring to the drawings in detail and particularly FIG. 1, the fence of this invention basically comprises a plurality of panels 10. In FIG. 1, for purposes of illustration, there is shown a single complete panel 10 and two partial panels 10. It will be understood that a completed fence will comprise, normally, a number of the panels extending around the area to be enclosed. The panels 10 which are substantially in alignment are supported by intermediate posts 12, and the panels 10 at each corner are supported by a corner post 14.

Each fence panel 10 comprises a plurality, such as three, horizontally extending, vertically spaced rails generally designated by reference character 16. Each rail 16 comprises a pair of flat metal bars 18 arranged in horizontally spaced, side-by-side relationship, with the opposite ends of each bar connected to a bolt 20, as by welding. As shown in FIG. 1A, the adjacent ends of the bars 18 are preferably curved slightly around the sides of the respective bolt 20 to provide an attractive appearance. The bars 18 are preferably formed of a cold rolled steel for ease and economy of manufacture.

Each panel 10 also includes a plurality of horizontally spaced, vertically extending pickets 22. Each picket 22 comprises a metal, flat bar 24 bent into the form of an inverted U, with the bend 26, located at the upper end of the picket, being rounded into substantially a semicircular configuration. Each picket 22 is positioned between the bars 18 of the rails 16 and is secured to the bars 18 by tack welding. The bars 24 forming the pickets 22 are preferably also a cold rolled steel to provide an economical and easily formed structure. It will further be noted that the upper ends of the pickets 22 extend a short distance above the upper rail 16 and the lower ends of the pickets 22 extend a short distance below the lowermost rail 16.

Figure 2:
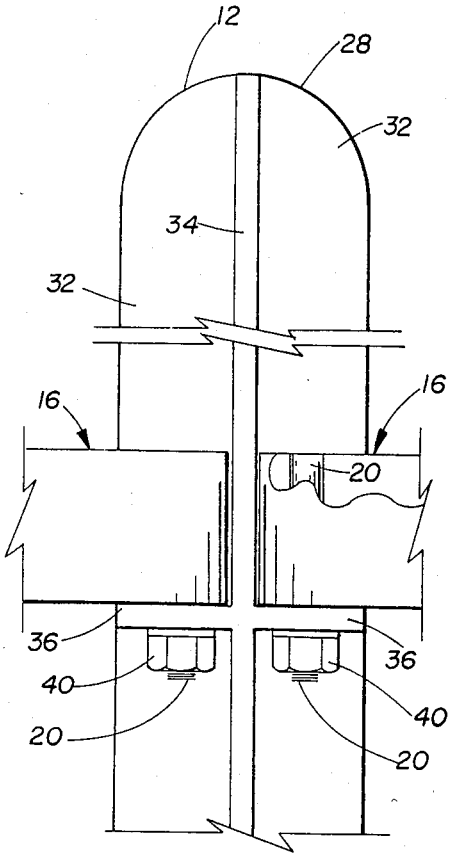
FIG. 2 is an enlarged elevational view of the upper portion of a post a section broken away for clarity.
Figure 3:
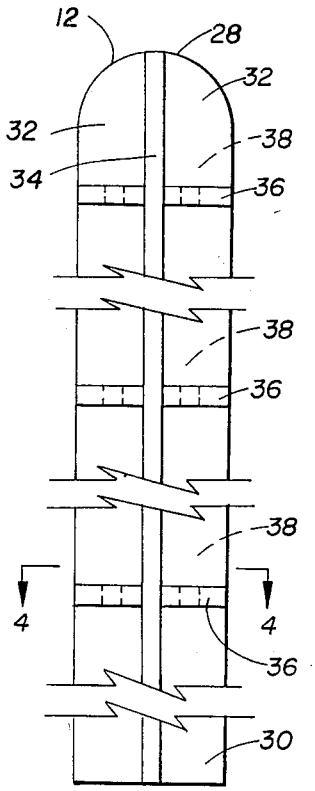
FIG. 3 is an elevational view of a typical post for use between adjacent fence panels.
Figure 5:
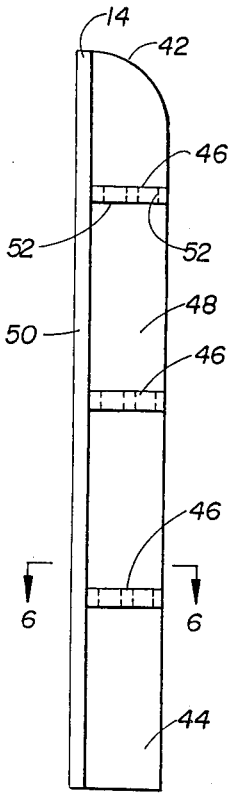
FIG. 5 is an elevational view of a corner post.
Figure 4:
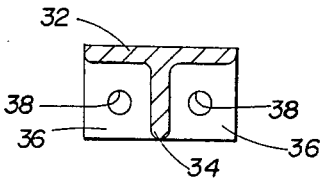
FIG. 4 is a sectional view taken along lines 4—4 of FIG. 3.
Figure 6:
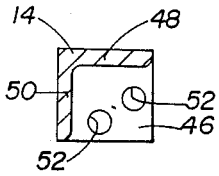
FIG. 6 is a cross sectional view taken along lines 6—6 of FIG. 5.

Each intermediate post 12, as shown most clearly in FIGS. 2, 3 and 4, is a standard T-shaped configuration, with the upper end 28 being rounded into a substantially semicircular configuration and the lower end 30 either pointed or square, depending upon the installation desired. The lower end portion 30 of the post will be secured in the supporting surface, such as the ground, either by being driven into the ground or being held by a concrete footing (not shown) in the normal manner of fence construction. The post 12 comprises a first vertical web 32, which will be extending parallel with the adjacent rails 16, and a second vertical web 34 extending normal from the central portion of the web 32. A horizontal web 36 is secured, as by welding, to the vertical webs 32 and 34 at each level for a rail 16. In the examples shown, there are three sets of horizontal webs 36, one for each rail 16. Each horizontal web 36 has an aperture 38 therein of a size to rather loosely receive the bolt 20 of the respective rail 16. As shown in FIG. 2, each bolt 20 is of a size to extend downwardly through the respective web 36 and is threaded at its lower end to receive a fastening nut 40. Each nut 40 is threaded onto the respective bolt 20 snugly against the lower surface of the respective horizontal web 36, such that the respective rail 16 will be firmly secured in the desired position.

Each corner post 14 has an L-shaped cross section, such as an angle iron, with the upper end portion 42 being rounded for the sake of appearance. The lower end portion 44 of a post 14 may be pointed or squared, as desired, for either being driven into the ground or secured by means of a concrete footing, as common in the installation of fences. A horizontal web 46 is secured to the vertical webs 48 and 50 of each post 14, at the level of each rail 16, as by being welded. A pair of apertures 52 are formed in each horizontal web 46 to receive the bolts 20 of adjacent rails 16, as is shown in FIG. 1. Here again, nuts are provided on the lower ends of the bolts 20 at each corner post to firmly secure the ends of the rails to the corner post.

The various posts 12 and 14 are also preferably formed of cold rolled steel and, as will be noted, these posts are of a standard shape for economy of manufacture. The upper ends of the posts 12 and 14 are preferably extended above the rails 16 about the same distance as the upper ends of the pickets 22. On the other hand, the lower ends of the posts 12 and 14 are extended sufficiently into the supporting structure such that the lower ends of the pickets 22 are spaced a short distance above the supporting structure, such as the ground.

Figure 7:
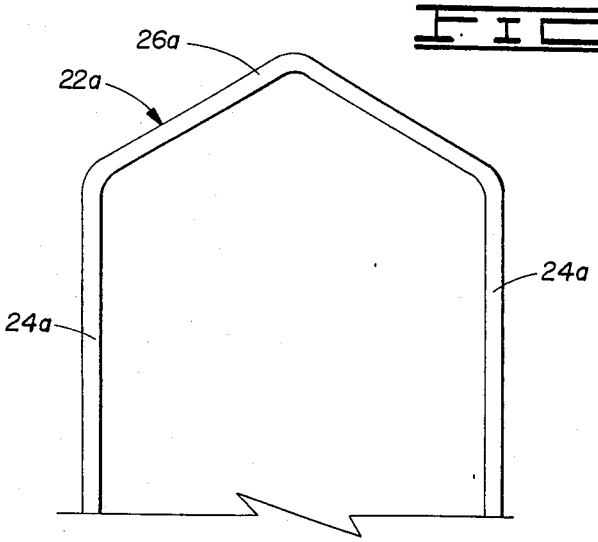
FIG. 7 is an enlarged elevational view of the upper portion of a modified picket.

A modified picket **22*a* is illustrated in FIG. 7. In this modified structure, the bend 26*a* of the bar 24*a* is in the form of an inverted V. When the picket structure shown in FIG. 7 is employed, the upper ends of the posts 12 and 14 may also be tapered to provide a corresponding appearance to the upper ends of the pickets 22***a*.

Changes may be made in the combination and arrangement of parts or elements as heretofore set forth in the specification and shown in the drawings without departing from the spirit and scope of the invention as defined in the following claims.

What is claimed is:

1. A fence to be mounted on a supporting structure comprising:

a plurality of panels, each panel comprising:

at least two horizontal rails, each of which includes a pair or horizontally spaced bars having their adjacent ends interconnected; and a plurality of vertically extending, horizontally spaced pickets positioned between said horizontally spaced bars, each picket including a bar formed into an inverted U, wherein each picket is welded to at least a portion of said rails;

a post between each pair of panels extending below the lower ends of said pickets and the lowermost rail for attachment to the supporting structure; and means securing the end of each rail to the adjacent post.

2. A fence as defined in claim 1 wherein each post between a pair or adjacent, substantially aligned panels has a T-shaped cross section forming a first vertical web parallel with the adjacent panels and a second vertical web extending normal from the central portion of the first web, and a horizontal web formed between the first and second webs at the level of each rail; and wherein each end of each rail adjacent a T-shaped post rests on and is secured to one of said horizontal webs.

3. A fence as defined in claim 2 wherein the means securing the end of each rail to the respective post comprises a bolt between and welded to the bars of the respective rail extending downwardly through a mating aperture in the respective horizontal web, and a nut on the lower end of the bolt.

4. A fence as defined in claim 1 wherein each post at a corner of the fence has an L-shaped cross section forming a pair of vertical webs extending at about ninety degrees from each other, and a horizontal web at the level of each rail supporting the adjacent end of the respective rail; and means connecting each horizontal web to the end of the respective rail.

5. A fence as defined in claim 4 wherein said means comprises a bolt between and welded to the bars of the respective rail extending downwardly through a mating aperture in said horizontal web, and a nut threaded onto the lower end of the bolt.

6. A fence as defined in claim 1 wherein that portion of each bar forming a picket located at the upper end of the picket is formed into a substantially semicircular configuration.

7. A fence as defined in claim 1 wherein that portion of each bar forming a picket located at the upper end of the picket is in the form of an inverted V.

* * * * *